US009975029B2

(12) United States Patent
Belt

(10) Patent No.: US 9,975,029 B2
(45) Date of Patent: May 22, 2018

(54) BATTER'S EYE DEVICES

(71) Applicant: Tom Belt, Waterloo, IL (US)

(72) Inventor: Tom Belt, Waterloo, IL (US)

( * ) Notice: Subject to any disclaimer, the term of this patent is extended or adjusted under 35 U.S.C. 154(b) by 0 days. days.

(21) Appl. No.: 15/096,025

(22) Filed: Apr. 11, 2016

(65) Prior Publication Data

US 2016/0296823 A1 Oct. 13, 2016

Related U.S. Application Data

(60) Provisional application No. 62/145,973, filed on Apr. 10, 2015.

(51) Int. Cl.

| | |
|---|---|
| ***A63B 69/00*** | (2006.01) |
| ***A63B 71/02*** | (2006.01) |
| *A63B 69/38* | (2006.01) |
| *A63B 71/06* | (2006.01) |

(52) U.S. Cl.

CPC ..... *A63B 71/022* (2013.01); *A63B 69/38* (2013.01); *A63B 2069/0008* (2013.01); *A63B 2071/0694* (2013.01); *A63B 2210/50* (2013.01); *A63B 2225/093* (2013.01)

(58) Field of Classification Search

CPC ..... A63B 71/022; A63B 69/38; A63B 2071/0694; A63B 2210/50; A63B 2225/093; A63B 63/00

USPC ..... 473/421, 422, 451, 190, 465, 490, 162, 473/172, 454, 462; 160/113, 119, 89, 160/330; 273/407, 410

See application file for complete search history.

(56) References Cited

U.S. PATENT DOCUMENTS

| | | | | |
|---|---|---|---|---|
| 3,192,991 A * | 7/1965 | Anderle | E06B 9/32 | 160/167 R |
| 4,153,246 A * | 5/1979 | Byrne | A63B 63/00 | 473/454 |
| 4,461,477 A | 7/1984 | Stewart | | |
| 4,596,093 A * | 6/1986 | Esposito | A01G 9/227 | 160/241 |
| 4,733,711 A * | 3/1988 | Schon | E06B 9/262 | 160/279 |
| 4,744,403 A * | 5/1988 | Hausmann | E04B 1/0046 | 160/272 |
| 5,007,645 A * | 4/1991 | Weigl | A63B 71/022 | 473/421 |
| 5,116,056 A * | 5/1992 | Schmutte | A63B 63/00 | 473/421 |

(Continued)

*Primary Examiner* — Mitra Aryanpour
(74) *Attorney, Agent, or Firm* — Sandberg Phoenix & Von Gontard, P.C.

(57) ABSTRACT

A device, such as a batter's eye, is provided for improved contrast of a propelled object, such as a baseball, to a subject, such as a batter, located in contraposition to the propelled object and the device. The device includes a backdrop component which includes a fabric semi-permeable to wind which is adapted to provide contrast to the propelled object when raised behind the propelled object. The backdrop further includes at least two vertically spaced sections of at least about two feet in height. The device also includes means for raising and lowering the backdrop between closed and opened positions and means for securely, but detachably, anchoring the device at a predetermined location but which also permit ready removal of the device. Methods for utilizing the device are also provided.

13 Claims, 5 Drawing Sheets

(56) References Cited

U.S. PATENT DOCUMENTS 5,195,569 A * 3/1993 Peterson ..... E06B 9/327 160/84.06
5,205,564 A * 4/1993 Lamberti ..... A63B 71/022 473/421
5,515,898 A * 5/1996 Alcocer ..... B64C 1/1484 160/265
5,820,494 A * 10/1998 Gates ..... A63B 71/022 473/421
6,482,112 B1 * 11/2002 Betz ..... A63B 71/022 473/421
6,530,413 B2 * 3/2003 Hwang ..... E06B 9/262 160/84.03
6,550,520 B1 * 4/2003 Rossini ..... E06B 9/264 160/107
7,297,076 B2 * 11/2007 Pohrer ..... A63B 61/00 473/415
7,520,311 B2 * 4/2009 Drew ..... E06B 9/322 160/171
7,841,378 B2 11/2010 Henning
8,365,797 B2 * 2/2013 Drew ..... E06B 9/262 160/173 R
8,561,665 B2 * 10/2013 Lin ..... E06B 9/322 160/167 R
8,747,259 B2 * 6/2014 Lay ..... A63B 71/022 473/421
9,004,139 B2 * 4/2015 Wu ..... E06B 9/262 160/167 R
2005/0020389 A1 * 1/2005 Peterson ..... A63B 71/022 473/421
2005/0101419 A1 * 5/2005 Pohrer ..... A63B 61/00 473/421
2007/0068636 A1 * 3/2007 Yu ..... E06B 9/322 160/168.1 R
2011/0265963 A1 * 11/2011 Drew ..... E06B 9/262 160/340
2012/0214618 A1 * 8/2012 Lay ..... A63B 71/022 473/421
2013/0316854 A1 * 11/2013 Lay ..... A63B 71/022 473/421

* cited by examiner

BATTER'S EYE DEVICES

CROSS-REFERENCE TO RELATED APPLICATIONS

This application claims the benefit of U.S. Provisional Patent Application Ser. No. 62/145,973, filed Apr. 10, 2015, which is hereby incorporated herein by reference.

STATEMENT REGARDING FEDERALLY SPONSORED RESEARCH OR DEVELOPMENT

Not applicable.

BACKGROUND OF THE INVENTION

The subject matter described herein relates generally to a "batter's eye," a device used to give a dark background for a baseball batter attempting to pick up a pitched ball. The device may be used in similar applications involving providing a darkened background, particularly in the context of sports and recreational activities.

Batter's eye devices or backdrops have long been a part of the baseball scene. Conventional batter's eyes or wind and light guards of this type are completely stationary and are constructed using an aluminum or mesh skin for the vertical backdrop.

Such stationary batter's eyes suffer from reduced durability, as they remain exposed in adverse weather conditions such as through the winter months and during the off-season. Further, they are largely immobile as they are planted into a fixed location.

Additionally, the conventional batter's eye is constructed of one piece, and therefore is subject to being degraded at a quicker rate, as it must face the full brunt of high winds and other inclement weather.

What is needed, therefore, is an improved batter's eye which may be readily raised and lowered automatically or manually, and is constructed to mitigate against the degradations suffered by conventional batter's eyes and wind and light-guards, and which are moveable without digging up the very foundations of the batter's eye.

BRIEF SUMMARY OF THE INVENTION

Accordingly, a batter's eye, or wind and light guard adapted to give contrast, is provided which addresses the needs and provides the advantages outlined herein. The batter's eye or guard is readily moveable or changeable, easy to maintain, and durable. The device's mesh or similar backdrop component has a darkened tint and may be semi-permeable to wind, may be changed out at any time, either in whole, or in preferred embodiments, in sections that may be damaged or weathered. Further, since the batter's eye of the invention contains sectioned portions of mesh or similar material, it retains its dark background, fulfilling its central purpose as a contrast to the pitched white, or light colored ball or object, yet it permits the wind to partially go through the sub-sections of the backdrop, thus lessening the wind's "wear and tear" on the batter's eye, but still serves as a partial wind break.

In an aspect of the invention a device for improved contrast of a propelled object for a subject located in contraposition to the propelled object and the device is provided. The device includes a backdrop component, means for raising and lowering the backdrop, and means for securely, but detachably anchoring the device at a predetermined location. The backdrop component includes a fabric semi-permeable to wind which is adapted to provide contrast to the propelled object, such as a baseball, when raised behind the propelled object, the backdrop further comprising at least two vertically spaced sections of at least about two feet in height.

In another aspect, a device for improved contrast of a propelled object, such as a baseball or tennis ball, for a subject, such as a batter or a tennis player, located in contraposition to the propelled object and the device is disclosed. The device includes a backdrop component comprising a fabric semi-permeable to wind, which is adapted to provide contrast to the propelled object when raised behind the propelled object. The backdrop component includes at least two vertically spaced sections of at least about two feet in height, a cable system for raising and lowering the backdrop including a plurality of cables which are in communication with the backdrop, and a transverse for rotationally urging the cable system to raise and lower the backdrop, a gear box for translationally urging a vertical shaft and a cranking rod for communication with a power source.

In another aspect of the invention a device for improved contrast of a propelled object for a subject located in contraposition to the propelled object and the device is provided. The device includes a backdrop component, means for raising and lowering the backdrop, and means for securely, but detachably anchoring the device at a pre-determined location.

Also provided is a method for providing improved contrast for a subject of a propelled object. The method involves placement of a device such as the types of devices described above and below in contraposition to the subject, such as a batter or a tennis player to enhance the subject's ability to pick up the propelled object.

BRIEF DESCRIPTION OF THE DRAWINGS

The presently disclosed subject matter will be better understood from reading the following description of non-limiting embodiments, with reference to the attached drawings, wherein below.

DETAILED DESCRIPTION OF THE INVENTION

Figure 1:
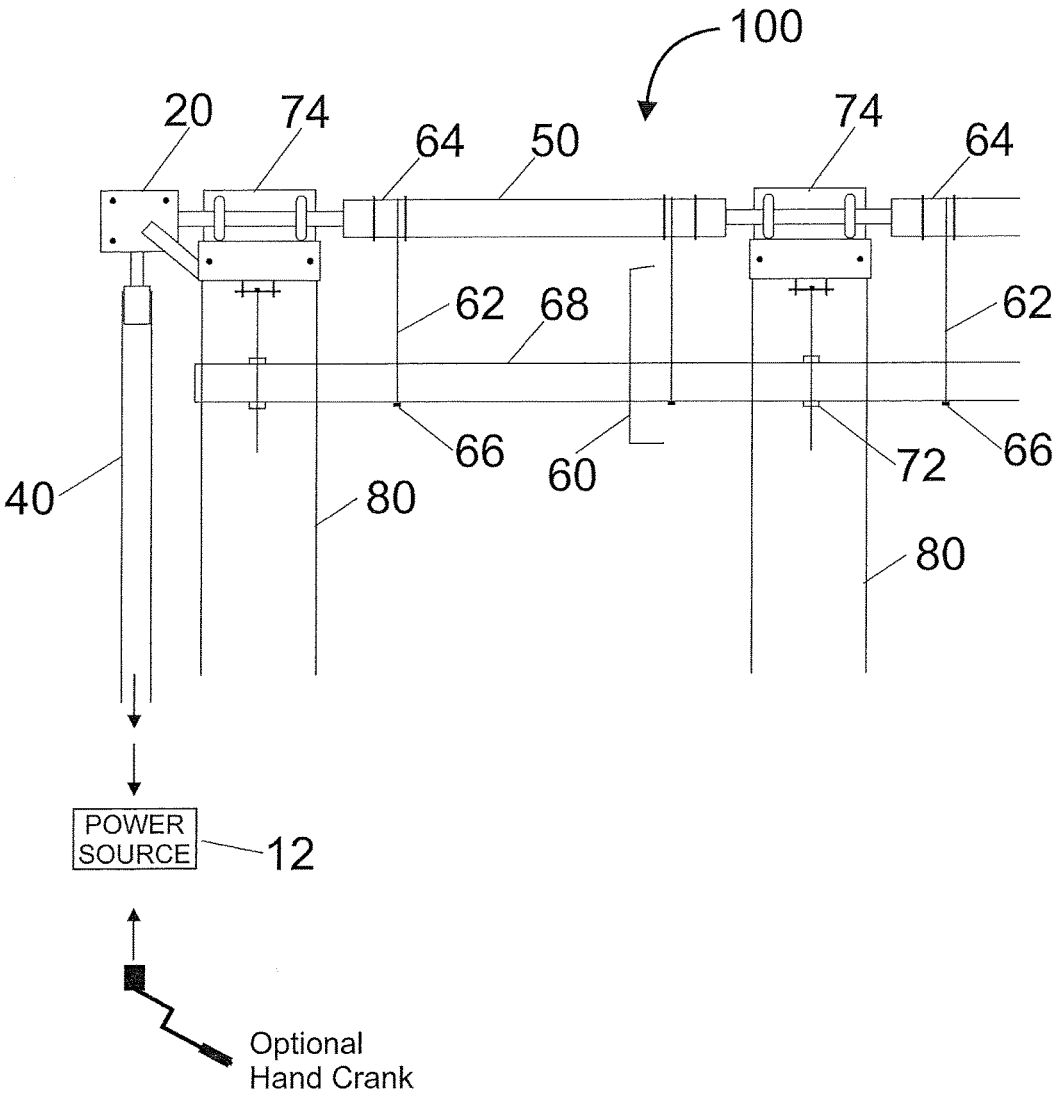
FIG. 1 is a schematic diagram of a partial front view of a preferred embodiment of the present invention showing exemplary components for raising and lowering the backdrop of a batter's eye or other device for providing improved contrast for a propelled object.

As used herein, an element or step recited in the singular and proceeded with the word "a" or "an" should be understood as not excluding the plural of said elements or steps, unless such exclusion is explicitly stated. Furthermore, references to "one embodiment" or "an embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Various embodiments as described and shown herein provide a retractable, durable, sectioned, moveable batter's eye, or wind and light guard device which gives substantial contrast to a pitched ball or other object, and provides some protection against unwanted wind or light. The batter's eye may be automatically raised in sections by use of an automatic, e.g., power drill cranking device or if desired in certain embodiments, a manual, e.g., hand crank. By allowing the batter's eye to be readily raised and lowered, it may be stored out of the elements in a closed position, or opened without delay when its service is needed. The device is also built (see illustrations) so that it may be moved about, or may be relocated should such a change be advisable or desired.

Referring to the various drawings, wherein identical reference numbers represent comparable components a device to provide improved contrast as to a propelled object to a subject in contraposition to the object and the device, such as a batter's eye 100 is shown which includes a backdrop or windscreen component 10. While this may be composed of other suitable materials which are flexible, durable, and, often, lightweight so long as it provides suitable contrast, it is preferably made of mesh, or mesh-like material, so as to be partially penetrable by wind. Such materials may include vinyl coated polyesters (VCPs) or other semi-permeable materials know to those skilled in the art as being suitable for reducing wind.

The backdrop fabric component can be tinted black, brown, dark blue or some other darker shade or shade providing contrast to the object to be propelled so as to assist in providing the desired contrast to a pitched ball or other object which is being thrown or otherwise propelled toward a batter, or person viewing the ball or other object from the direction of a plate or other perspective in alignment with and in contraposition to the direction from which the baseball or other object is being thrown. Depending on conditions, and choice, varying shades of "darkness", such as 70%, 75%, 80%, 85% and other gradations of "shade", known to those skilled in the art, may be selected for the mesh or other backdrop material.

The backdrop 10, as shown in the Figures, may be constructed in vertical sections (e.g., 10*a*, 10*b*, 10*c*), e.g., 2, 3, 4, 5 or 6 or more feet in height, each, which may be envisioned as operating similarly to the reverse of, but with similar principle to, that of a window's window blinds. It is envisioned that these vertical sections may partially separate to reduce wind resistance and prevent or inhibit "sail" billowing of the material. In a preferred embodiment, backdrop fabric sections of at least ten (10) square or more feet in area, are employed so that any individual section or group of section, having been ripped or otherwise damaged, or suffering from wear or tear, may be swapped out and replaced with a fresh section of fabric, and reconnected to the backdrop component, e.g., using grommets and strong ties of suitable material. Thus, the sections of the batter's eye backdrop 10 may be automatically raised, e.g., using a power source 12 (depicted in FIG. 1, see block diagram) including an electric and/or mechanical apparatus, such as a right-angle drill, or alternatively, a manual, e.g., a hand crank.

Figure 2:
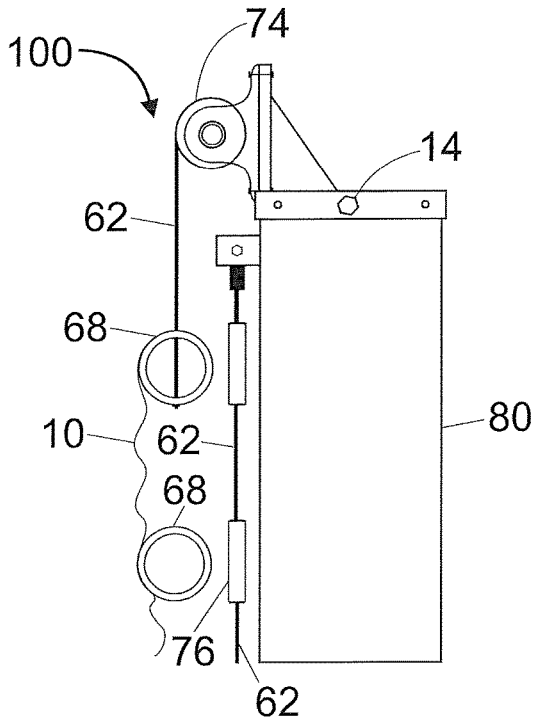
FIG. 2 is a schematic diagram of a partial side view of the preferred embodiment of the invention shown in FIG. 1.

As shown in the illustrations, in a preferred embodiment of the batter's eye or other device of the invention, the backdrop component 10 is readily raised and lowered using a gear box 20 at the top, a cranking rod 30, vertical shaft 40, transverse shaft 50 and cable system 60, including cables 62, drums 64, cable clamps 66, and the like (see, e.g., FIGS. 1-6.) Additional components, as shown in FIGS. 1 and 2, include the cross-pipe 68 for attachment of the backdrop component, which can be assisted by use of cross-pipe sleeves 72. To aid in raising and lowering the backdrop, a useful component is the pillow block bearings unit 74 and steel tube sleeves 76 for the cables 62.

In this embodiment, support is provided by six inch pipes or posts 80 adjacent the cables 62, and with safety bolts 14 to support the attachments of the bearings.

Figure 3:
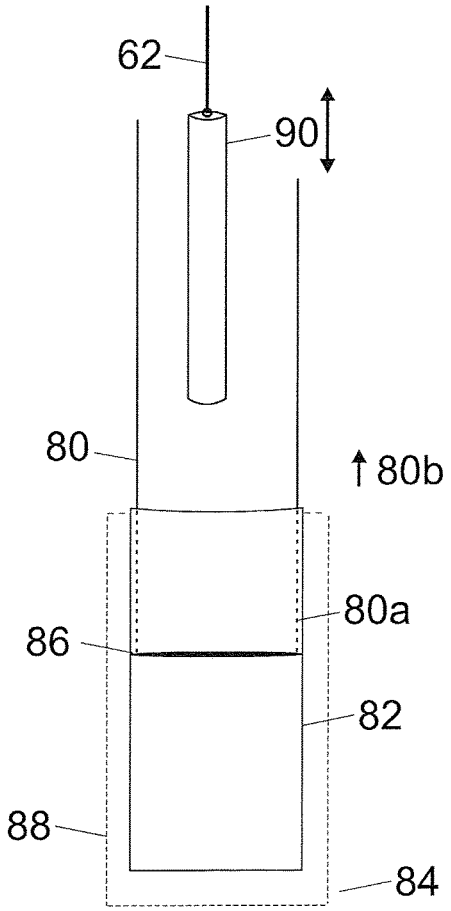
FIG. 3 is a schematic depiction of the interconnection of the pipe, pipe sleeve and hole preparation of a preferred embodiment of the invention showing a preparation and components providing for securely, but detachably anchoring the device at a pre-determined location.
Figure 4:
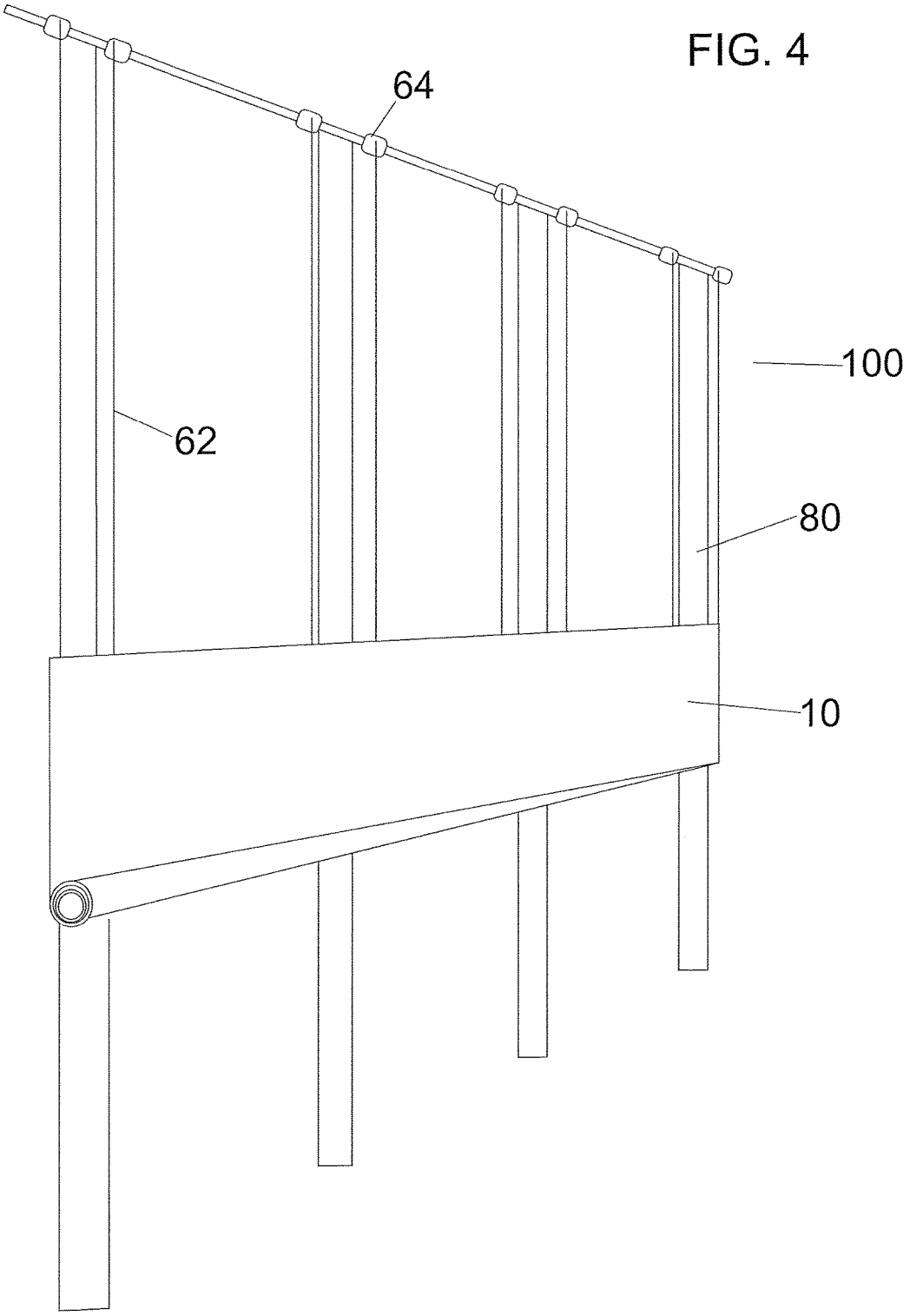
FIG. 4 is a perspective view of a working model of the preferred embodiment of the invention shown in FIG. 1, wherein the backdrop component material is in a mostly closed position.
Figure 5:
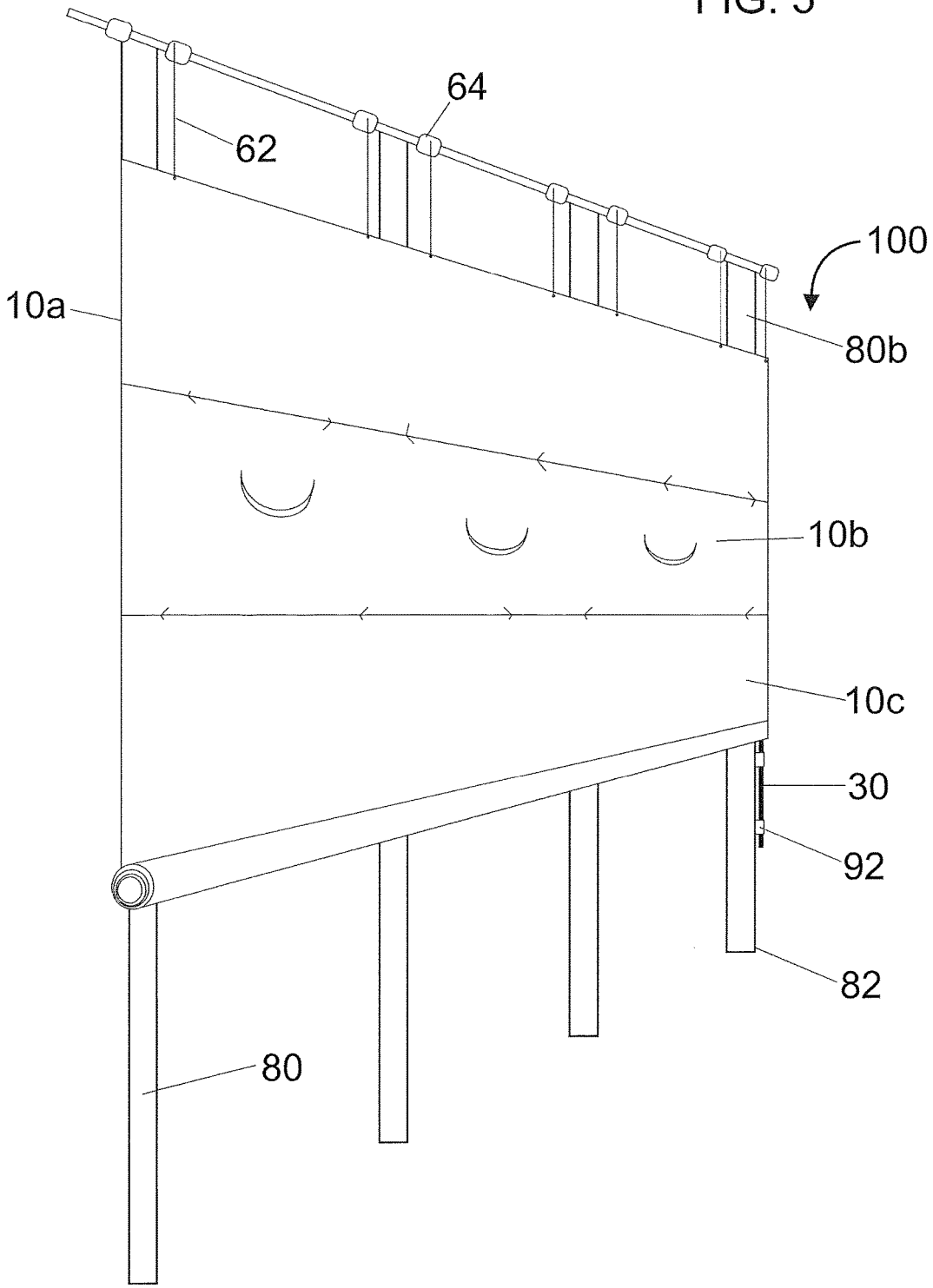
FIG. 5 is a perspective view of the preferred embodiment of the invention shown in FIG. 1 wherein the backdrop material has been raised to approximately three-quarters of its full height.
Figure 6:
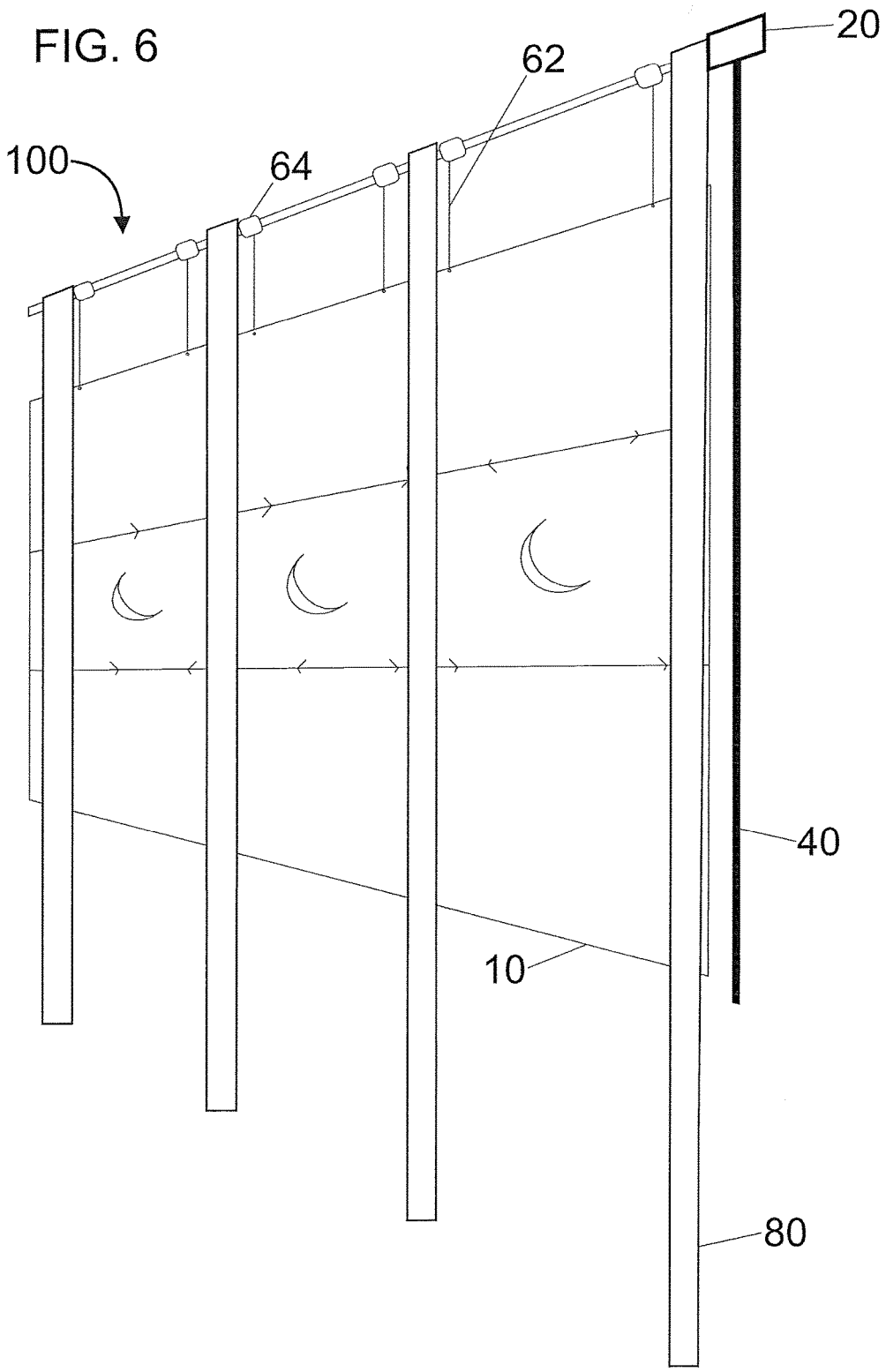
FIG. 6 is a front view of the preferred embodiment of the invention shown in FIG. 1 wherein the backdrop material has been raised to its fully-opened position. Note that optional wind holes have been included in this preferred embodiment of the backdrop to reduce wind resistance.

In an embodiment, means for securely but readily detachably anchoring the device at a pre-determined location is provided. As shown in FIG. 3, a 6"×26'0" schedule (sch) 40 pipe or post 80 is used to support the backdrop 10. The pipe's upper portion 80*b* is largely behind the backdrop 10 for support, while the lower portion 80*a* is configured as part of an anchoring unit which provides secure anchoring, but permits ready removal of the device to a second location. As shown in FIG. 3, the lower portion 80*a* of each pipe 80, being located within a 7"-8"×72 sch 40 pipe sleeve 82 configured so that the pipes 80 or posts fit snugly but removably within the pipe sleeves 82. As depicted, the pipe 80 slides into the pipe sleeve 82 until prevented from going any further by a sch 40 stop plate 86. The pipe sleeves 82 in turn being encased in a material, or otherwise securely, but removably positioned. Here, 24" diameter ×72" deep holes are filled with 6,000 psi concrete 88, adapted to maintain the device in a secure and upright position.

The individual fabric sections can include grommets to reduce tearing and ordinary wear of the fabric during tying and use, to aid durability and to prevent a "giant sail" effect (see, e.g., Figs.).

In additional or alternative embodiments, pipes 80 may be added with cable and counter (e.g., 10 pound) weights, separate drum reverse turn and wound.

Another option is to add stems 92 off the pipes 80 to hold the cranking or turning rods 30 in place.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the invention without departing from their scope. While the dimensions and types of materials described herein are intended to define the parameters of the various embodiments of the invention, the embodiments are by no means limiting and are exemplary embodiments. Many other embodiments will be apparent to those of skill in the art upon reviewing the above description. The scope of the various embodiments of the invention should, therefore, be determined with reference to the appended claims, along with the full scope of equivalents to which such claims are entitled.

What is claimed is:

1. A device for providing improved contrast of a propelled object for a subject located in contraposition to the propelled object and the device, the device comprising:

a backdrop component comprising a fabric having at least a 70% shade rating semi-permeable to wind adapted to provide contrast to the propelled object when raised behind the propelled object, the backdrop further comprising a cable system for raising and lowering the backdrop comprising a plurality of cables which are in communication with the backdrop, a transverse shaft attached to the plurality of cables configured for rotationally urging the cable system to raise and lower the backdrop, a cross-pipe attached to the backdrop and around which the backdrop is wound and unwound as the backdrop is lowered and raised, a gear box configured for translationally urging a vertical shaft and a cranking rod for communication with a power source.

2. The device of claim 1 further comprising a plurality of pipes or posts attached to and providing support for the backdrop, which pipes or posts have lower and upper portions, the lower portions of each being configured to fit snugly but removably within a pipe sleeve, the pipe sleeves in turn being encased in a material adapted to maintain the device in a secure and upright position.

3. The device of claim 1 wherein the backdrop further comprises discrete units of fabric which are detachably joined together so that one or more of the discrete units can be removed and replaced as needed.

4. The device of claim 1 wherein the backdrop, when fully extended occupies a generally two-dimensional planar space.

5. The device of claim 2 wherein the material encasing the pipe sleeves is located in holes at least partially below surface level.

6. A method for providing improved contrast of a propelled object for a subject located in contraposition to the propelled object, the method comprising:

placement of a device behind a predetermined position for propelling an object to the subject to provide the improved contrast, the device comprising a backdrop component comprising a fabric having at least a 70% shade rating semi-permeable to wind adapted to provide contrast to the propelled object when raised behind the propelled object, the backdrop further comprising a cable system for raising and lowering the backdrop comprising a plurality of cables which are in communication with the backdrop, a transverse shaft attached to the plurality of cables configured for rotationally urging the cable system to raise and lower the backdrop, a cross-pipe attached to the backdrop and around which the backdrop is wound and unwound as the backdrop is lowered and raised, a gear box configured for translationally urging a vertical shaft and a cranking rod for communication with a power source.

7. The method of claim 6 wherein the backdrop further comprises discrete units of fabric which are detachably joined together so that one or more of the discrete units can be removed and replaced as needed.

8. The method of claim 7 wherein at least some of the discrete units of fabric have a surface area of at least ten square feet.

9. The method of claim 6 wherein the device further comprises a plurality of pipes or posts attached to and providing support for the backdrop, which pipes or posts have lower and upper portions, the lower portions of each being configured to fit snugly but removably within a pipe sleeve, the pipe sleeves in turn being encased in a material adapted to maintain the device in a secure and upright position.

10. The method of claim 6 wherein the propelled object is a baseball or softball and the subject is a batter.

11. The method of claim 6 wherein the propelled object is a tennis ball and the subject is a tennis player.

12. The method of claim 6 wherein the backdrop, when fully extended occupies a generally two-dimensional planar space.

13. The method of claim 9 wherein the material encasing the pipe sleeves is located in holes at least partially below surface level.

* * * * *